US012721428B2

(12) United States Patent
Clinard et al.

(10) Patent No.: US 12,721,428 B2
(45) Date of Patent: Sep. 1, 2026

(54) STORAGE CABINET

(71) Applicant: Kindred Products LLC, Benton Harbor, MI (US)

(72) Inventors: Sarah J. Clinard, Rolling Prairie, IN (US); Heidi Hurst, Saint Joseph, MI (US); Clayton Olsen, Portland, MI (US); Curtis Taylor, Benton Harbor, MI (US)

(73) Assignee: Kindred Products LLC, Benton Harbor, MI (US)

( * ) Notice: Subject to any disclaimer, the term of this patent is extended or adjusted under 35 U.S.C. 154(b) by 75 days.

(21) Appl. No.: 18/603,874

(22) Filed: Mar. 13, 2024

(65) Prior Publication Data

US 2025/0288095 A1 Sep. 18, 2025

(51) Int. Cl.

| | |
|---|---|
| ***A47B 47/00*** | (2006.01) |
| ***A47B 43/00*** | (2006.01) |
| ***A47B 47/03*** | (2006.01) |
| ***A47B 87/02*** | (2006.01) |
| *A47B 47/02* | (2006.01) |

(52) U.S. Cl.

CPC ..... *A47B 43/00* (2013.01); *A47B 47/00* (2013.01); *A47B 47/03* (2013.01); *A47B 87/02* (2013.01); *A47B 47/0075* (2013.01); *A47B 47/02* (2013.01); *A47B 2220/0072* (2013.01)

(58) Field of Classification Search

CPC ..... A47B 43/00; A47B 47/0091; A47B 47/00; A47B 47/03; A47B 47/02; A47B 47/0075; A47B 87/02; A47B 2220/0072

See application file for complete search history.

(56) References Cited

U.S. PATENT DOCUMENTS

| | | | | | |
|---|---|---|---|---|---|
| 892,187 | A * | 6/1908 | Schriefer | A47B 87/02 | 312/351 |
| 2,461,219 | A * | 2/1949 | Lew | A47B 47/03 | 312/351 |
| 3,619,853 | A * | 11/1971 | Merrill | E05D 3/12 | 16/389 |
| 4,265,501 | A * | 5/1981 | Halliburton | A47B 43/00 | 312/258 |
| 4,288,132 | A * | 9/1981 | Znamirowski | A47B 47/03 | 312/265.5 |
| 6,099,092 | A * | 8/2000 | Uffner | E05D 11/105 | 16/374 |
| 2004/0150302 | A1* | 8/2004 | McBrayer, III | A47B 43/00 | 312/258 |
| 2006/0260207 | A1* | 11/2006 | Chang | A47B 47/00 | 49/504 |
| 2008/0012455 | A1* | 1/2008 | Zheng | A47B 47/0075 | 312/262 |

(Continued)

FOREIGN PATENT DOCUMENTS

| | | | | |
|---|---|---|---|---|
| CN | 111685493 | A * | 9/2020 | E06B 3/367 |
| JP | 2016209156 | A * | 12/2016 | |

*Primary Examiner* — Kimberley S Wright

(74) *Attorney, Agent, or Firm* — Warner Norcross + Judd LLP

(57) ABSTRACT

A storage cabinet includes a frame, a top panel, a bottom panel, and a plurality of doors. The frame can include hinged side panels, and the doors are connected to the side panels. A kit for assembling the storage cabinet and a method of assembling the storage cabinet are also provided.

16 Claims, 14 Drawing Sheets

(56) References Cited

U.S. PATENT DOCUMENTS

| | | | | |
|---|---|---|---|---|
| 2013/0264924 | A1* | 10/2013 | Tusk | A47B 47/0041 312/265.5 |
| 2016/0100684 | A1* | 4/2016 | Koehn | A47B 57/16 312/258 |
| 2016/0331128 | A1* | 11/2016 | Chuang | A47B 96/02 |
| 2020/0178686 | A1* | 6/2020 | Hermann | A47B 46/00 |
| 2022/0395092 | A1* | 12/2022 | Holland | A47B 43/00 |
| 2023/0189985 | A1* | 6/2023 | Doherty | E05D 3/12 312/258 |

* cited by examiner

STORAGE CABINET

BACKGROUND

Cabinets are a common as storage solution, offering a designated space to store and organize items, thereby reducing clutter and promoting tidiness in both residential and commercial environments. Beyond storage, cabinets also fulfill the role of protection and preservation, safeguarding items from dust, moisture, and other environmental factors that may cause damage or deterioration. This is particularly crucial for sensitive or valuable belongings, such as documents, electronic equipment, or delicate items. Moreover, cabinets contribute to space optimization by efficiently utilizing vertical and horizontal dimensions, allowing for efficient organization and maximizing available space. This is especially beneficial in environments where space is limited, such as homes, offices, or industrial facilities.

"Ready-to-assemble" or "knock-down" storage cabinets are preferred by many users because they come in easy to transport packaging and are cost-effective, which are achieved by requiring user assembly. It is important in ready-to-assemble storage cabinets that they are easy to assemble and are durable, both in structure and finish, and lightweight so that the cabinet can be shipped in a package of minimal size so as to occupy a minimal storage volume and be easy to transport.

In addition to their functional aspects, cabinets also play a significant role in the aesthetics of a space. Metal ready-to-assemble cabinets have often been reserved for the garage in a functional role and housing items that are typical eye sores to be left outside of the cabinet. Storage cabinets that focus on functionality and not aesthetic appeal limit a consumer's desire to utilize such storage cabinets outside of garages.

There is a need for easy to assemble, efficient storage cabinets that declutter and organize, and that can enhance the aesthetics of a space so that it can be utilized in a variety of environments.

BRIEF SUMMARY

A storage cabinet is provided.

In one aspect of the disclosure, a storage cabinet defining a storage chamber is provided, the storage cabinet including a frame including a back panel having a first end and a second end, a first side panel rotatably connected to the first end of the back panel by at least one first panel hinge, the first side panel comprising a mounting plate on an interior surface of the first side panel, and a second side panel rotatably connected to the second end of the back panel by at least one second panel hinge, the second side panel comprising a mounting plate on an interior surface of the second side panel, a top panel connected to an upper end of the frame, a bottom panel connected to a bottom end of the frame, a first door rotatably connected to the first side panel by at least one first door hinge comprising a hinge component on an interior surface of the first door coupled with the mounting plate on the interior surface of the first side panel, and a second door rotatably connected to the second side panel by at least one second door hinge comprising a hinge component on an interior surface of the second door coupled with the mounting plate on the interior surface of the second side panel.

In these and other aspects of the disclosure, the back panel has a first end extension panel and a second end extension panel, wherein the first side panel is rotatably connected to the first end extension panel by the first panel hinge and the second side panel rotatably connected to the second end extension panel by the second panel hinge.

In these and other aspects of the disclosure, the top panel and/or the bottom panel are lockable to the side panels of the frame 14 using a tab-and-slot interface.

In these and other aspects of the disclosure, the frame has a plurality of adjustable feet, In these and other aspects of the disclosure, the frame has an at least partially hollow construction including a plurality of vertically-extending hollow channels.

In these and other aspects of the disclosure, the door hinges are concealed door hinges and/or soft close door hinges.

In these and other aspects of the disclosure, the storage cabinet has at least one adjustable shelf mounted to the frame within the storage chamber. The storage cabinet can have a plurality of shelf clips removably coupled to the frame within the storage chamber, wherein the frame comprises a plurality of discreet attachment points for attachment of the shelf clips at different heights on the frame.

In these and other aspects of the disclosure, the frame includes an upper frame sub-assembly comprising the back panel, first side panel, and second side panel, wherein the back panel is an upper back panel, a lower frame sub-assembly including a lower back panel having a first end and a second end, a third side panel rotatably connected to the first end of the lower back panel by at least one third panel hinge, the first side panel comprising a mounting plate on an interior surface of the third side panel, and a fourth side panel rotatably connected to the second end of the lower back panel by at least one fourth panel hinge, the second side panel comprising a mounting plate on an interior surface of the fourth side panel, a third door rotatably connected to the third side panel by at least one third door hinge comprising a hinge component on an interior surface of the third door coupled with the mounting plate on the interior surface of the third side panel, and a fourth door rotatably connected to the fourth side panel by at least one fourth door hinge comprising a hinge component on an interior surface of the fourth door coupled with the mounting plate on the interior surface of the fourth side panel, wherein the top panel is connected to an upper end of the upper frame sub-assembly, and wherein the bottom panel is connected to a bottom end of the lower frame sub-assembly.

In another aspect of the disclosure, a kit for assembling a storage cabinet is provided. The kit can include a pre-assembled frame including aa back panel having an interior surface, a first end and a second end, a first side panel rotatably connected to the first end of the back panel by at least one first panel hinge, the first side panel comprising a mounting plate on an interior surface of the first side panel, and a second side panel rotatably connected to the second end of the back panel by at least one second panel hinge, the second side panel comprising a mounting plate on an interior surface of the second side panel, wherein the pre-assembled frame comprises a folded position in which the first and second side panels are oriented substantially parallel to the interior surface of the back panel and an unfolded position in which the first and second side panels are oriented substantially orthogonally to the interior surface of the back panel, a top wall connectable to an upper end of the pre-assembled frame in the unfolded position, a bottom wall connectable to a bottom end of the pre-assembled frame in the unfolded position, a first door rotatably connectable to the first side panel by at least one first door hinge comprising a hinge component on an interior surface of the first door that is couplable with the mounting plate on the interior surface of the first side panel, and a second door rotatably connectable to the second side panel by at least one second door hinge comprising a hinge component on an interior surface of the second door coupled with the mounting plate on the interior surface of the second side panel.

In yet another aspect of the disclosure, a method for assembling a storage cabinet is provided.

These and other features and advantages of the present disclosure will become apparent from the following description of particular embodiments, when viewed in accordance with the accompanying drawings and appended claims.

DESCRIPTION OF THE DRAWINGS

Various advantages and aspects of this disclosure may be understood in view of the following detailed description when considered in connection with the accompanying drawings, wherein.

DETAILED DESCRIPTION

Figure 1:
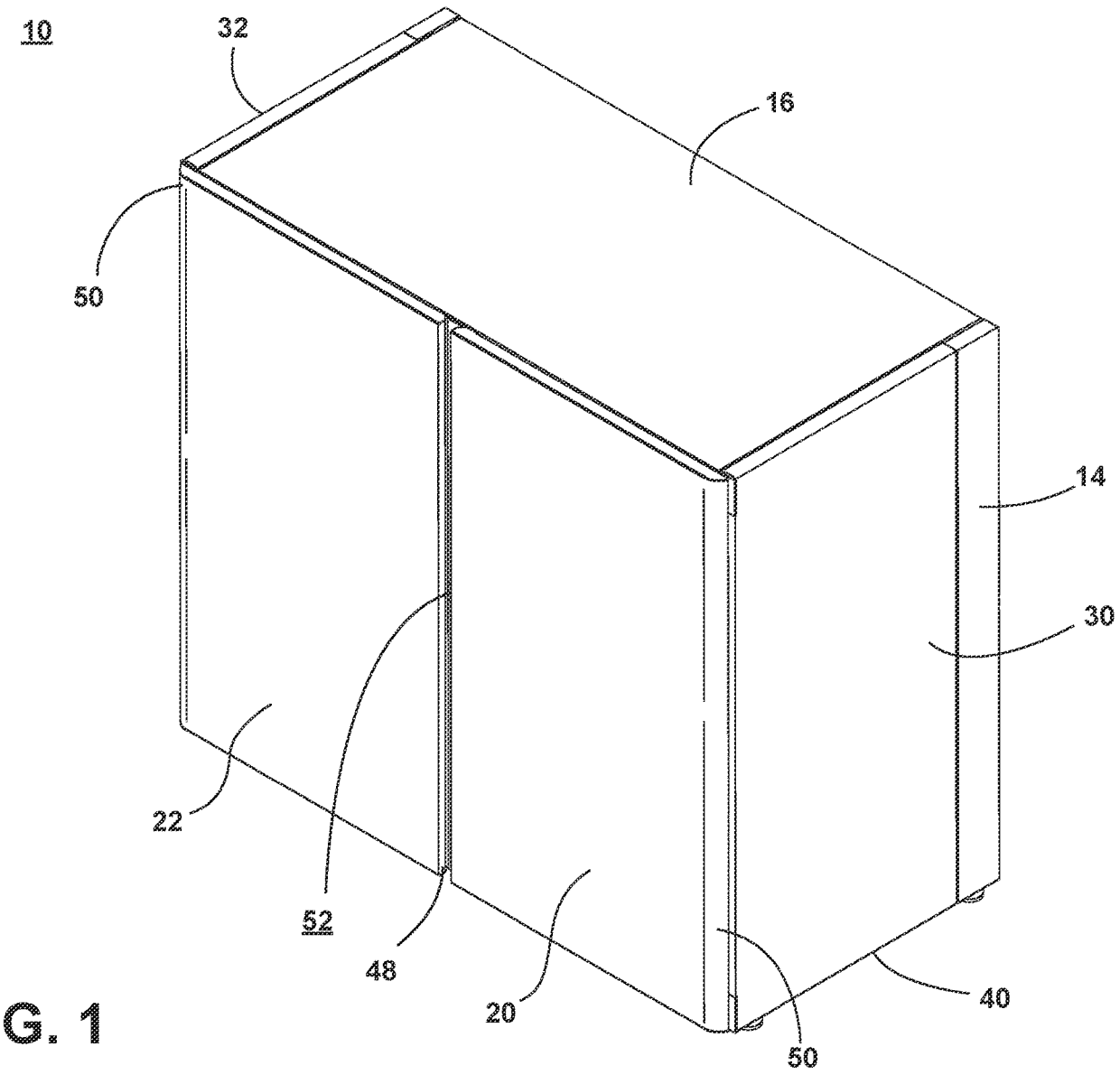
FIG. 1 is a perspective view of a storage cabinet in accordance one aspect of this disclosure.

A storage cabinet, a kit for assembling the storage cabinet, and a method of assembling the storage cabinet are provided. The storage cabinet according to at least some of the aspects disclosed is useable as a storage solution in homes, including in pantries, laundry rooms, closets, and basements, garages, offices, industrial facilities, commercial environments, and other locations. The storage cabinet according to at least some of the aspects disclosed is a ready-to-assemble cabinet having pre-assembled components allow for a quick assembly allowing consumers to start using the storage cabinet immediately. The storage cabinet according to at least some of the aspects disclosed herein has hinged side panels with no exposed hardware once the cabinet is assembled. The storage cabinet according to at least some of the aspects disclosed herein has quick-connect, soft close door hinges for minimal noise. In addition to their functional aspects, the storage cabinet 10 disclosed herein can also play a significant role in enhancing aesthetics and interior design of a space. The cabinet 10 can be designed to complement the overall decor and style of a space, contributing to its visual appeal and creating a cohesive look. The aesthetic design allows for a seamless transition from the garage to any room in the home. Certain features of the storage cabinet 10 are functional but can be implemented in different aesthetic configurations.

Referring to FIGS. 1-12, wherein like numerals indicate corresponding parts throughout the several views, the storage cabinet according to one aspect of the disclosure is illustrated and is generally designated as 10. The storage cabinet 10 has a rectanguloid shape and defines a storage chamber 12. The storage cabinet 10 includes a frame 14, a top panel 16, a bottom panel 18, and a first and a second door 20, 22. The construction of the storage cabinet 10 is described in greater detail below.

The frame 14 can include a back panel 24, a first and a second side panel 30, 32, and one or more panel hinges 34 rotatably connecting the side panels 30, 32 to the back panel 24. The top panel 16 is connected to an upper end 38 of the frame 14 and the bottom panel 18 is connected to a bottom end 40 of the frame 14. The assembled frame 14, top panel 16, and bottom panel 18 can form a cabinet body.

The storage cabinet 10 may, in some embodiments, include one or more interior organizational components for the storage chamber 12. For example, the storage cabinet 10 can include a shelf 26 mounted to the frame 14 within the storage chamber 12. Other organizational components such as additional shelves, bins, racks, and like may be installed in the cabinet 10.

Figure 2:
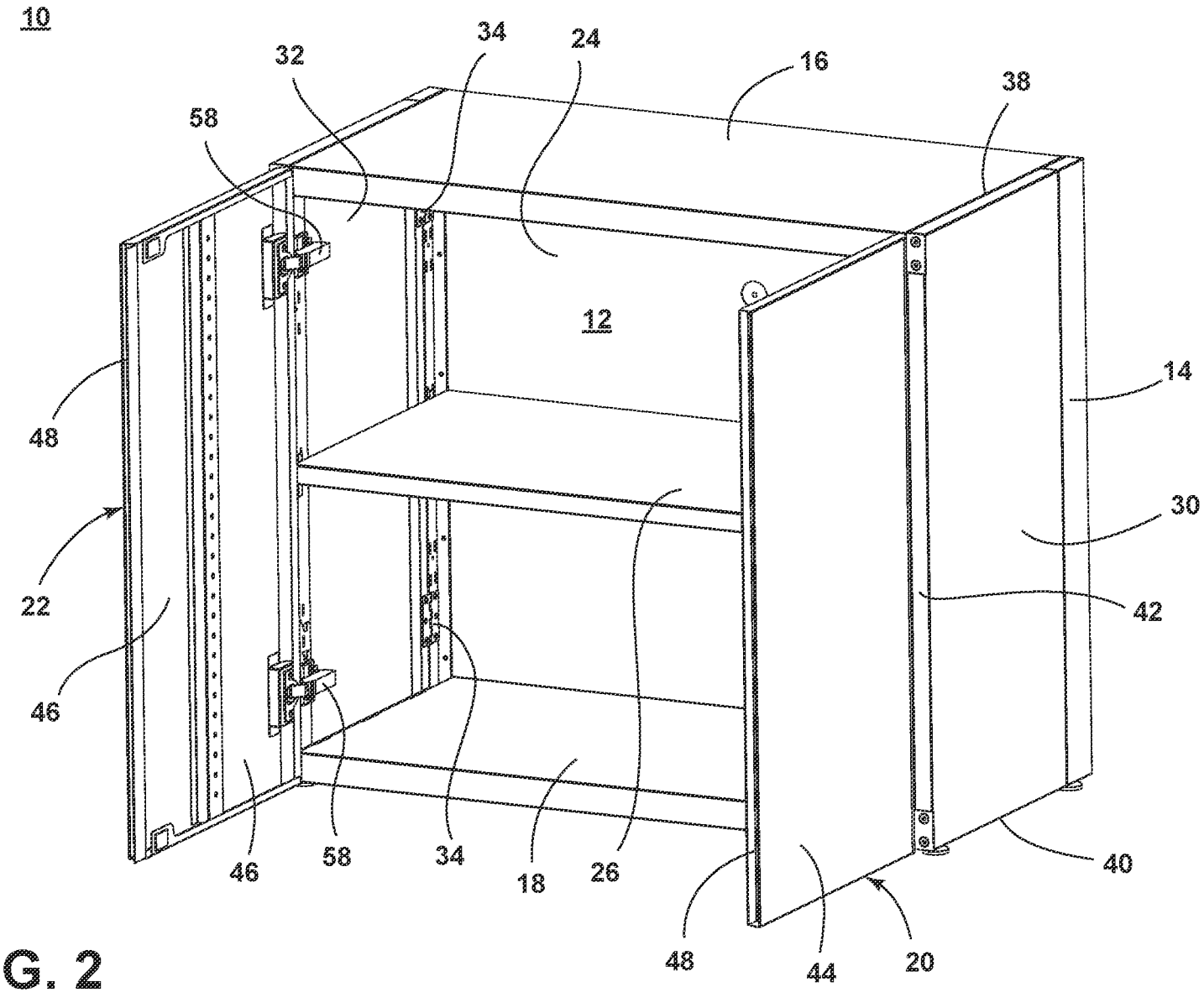
FIG. 2 is a perspective view of the storage cabinet of FIG. 1 with doors of the cabinet in an open position wherein a storage chamber of the cabinet is accessible from an exterior of the cabinet.

The doors 20, 22 are supported by the frame 14 and are connected to a front end 42 of the frame. The doors 20, 22 are movable between a closed position, an example of which is shown in FIG. 1, and an open position wherein the storage chamber 12 is accessible from an exterior of the storage cabinet 10, an example of which is shown in FIG. 2.

The storage cabinet 10 can include metal, wood, a polymeric material, a composite material, or combinations thereof. In one embodiment, the panels 16, 18, 24, 30, 32 and/or doors 20, 22 include metal, and may be powder coated for durability, UV protection, and/or rust resistance.

The doors 20, 22 can function to enhance the aesthetic appeal of the cabinet 10 in that the doors 20, 22 can have a decorative aesthetic customizable in material, color, pattern, texture, finish, logo, graphic, text, etc. While the doors 20, 22 are shown unadorned, the doors 20, 22 can have a decorative aesthetic. The storage cabinet 10 can be customized in different ways using one or more doors 20, 22 that can be added to the frame 14. For example, the doors 20, 22 can be a wood or colored metal closure for a metal frame 14. As another example, the doors 20, 22 can have printed matter formed thereon, such as printed image of a scene, a place a person, a pet, a team logo, a graphic or text. Any number of different themes can be displayed and conveyed by the doors 20, 22 and the ability to customize the doors 20, 22 allows the cabinet 10 to be designed with a theme in mind.

The doors 20, 22 define an exterior surface 44 and an interior surface 46 opposite the exterior surface 44. The doors 20, 22 typically present exterior surfaces 44 that are rectangular or square but is not limited to a particular shape. Each door is supported by the frame 14 is movable between a closed position wherein the exterior surface 44 defines a front surface of the cabinet 10 and the interior surface 46 faces toward and opposes the back panel 24 and an open position wherein the storage chamber 12 is accessible from an exterior of the storage cabinet 10.

Each door has an inner edge 48 and an outer edge 50. In the closed position, the inner edges 48 of the doors 20, 22 can face toward end other, and in some embodiments may be spaced by a gap 52 size to receive a user's fingers, whereby a user can insert their fingers in the gap 52 for leverage in opening the doors 20, 22 by the inner edge 48. In other embodiments, handle hardware may be attached on exterior surface 44 of the doors 20, 22. In some embodiments, the inner and outer edges 48, 50 of the first and/or the second door 20 comprises a beveled or rounded corner although other shapes and profiles for the edges are possible.

Figure 3:
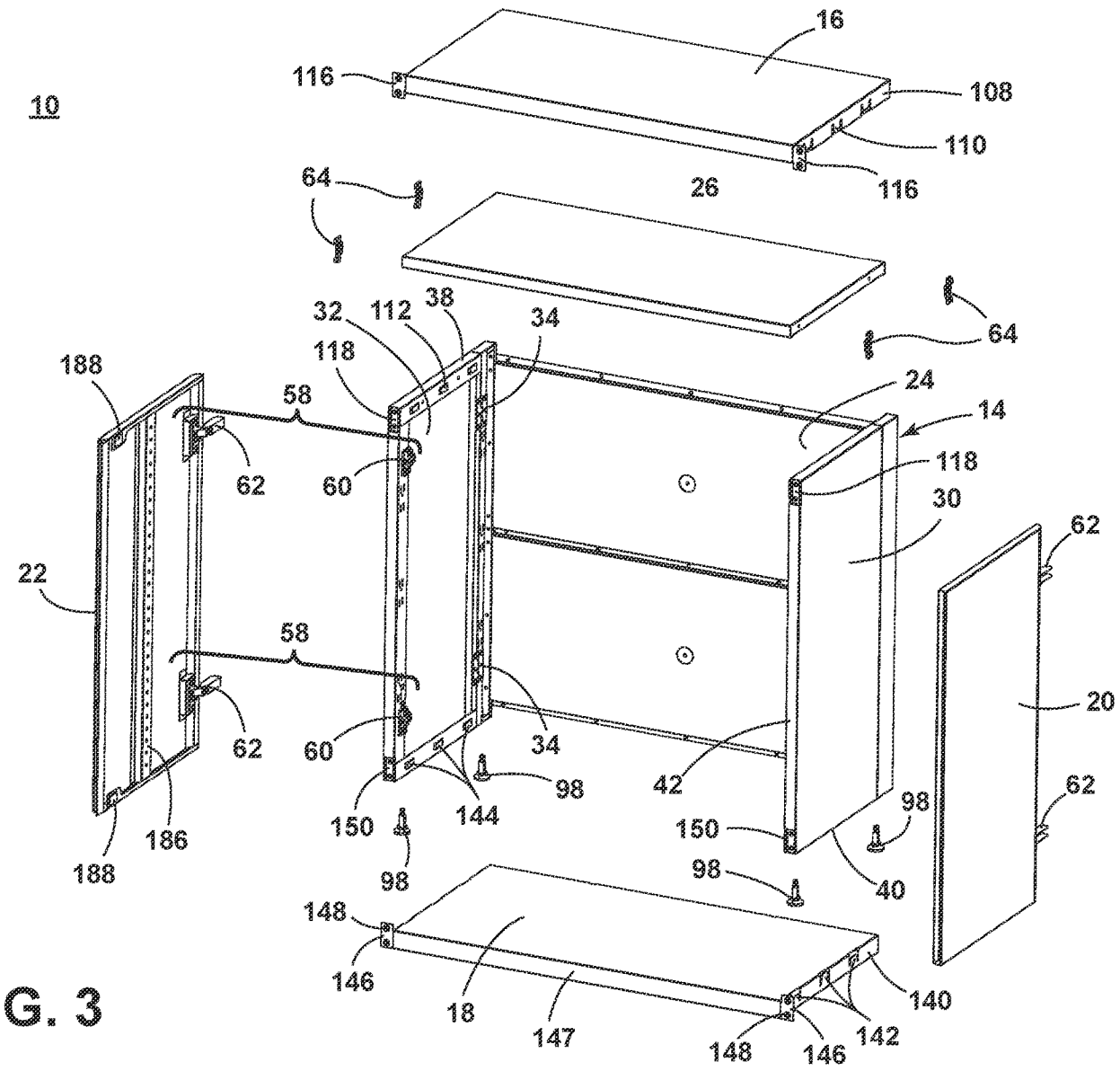
FIG. 3 is an exploded view of the storage cabinet of FIG. 1.

FIG. 3 is an exploded view of the cabinet 10. In one aspect of the disclosure, the cabinet 10 is a ready-to-assemble cabinet 10 and the frame 14 is a pre-assembled frame or sub-assembly designed to provide quick and efficient assembly of the storage cabinet 10. The top and bottom panels 16, 18, doors 20, 22, and the optional shelf 26, are separate from the frame 14 and require user assembly. The cabinet 10 can be shipped as a flat-pack, ready-to-assemble kit, with the side panels 30, 32 of the frame 14 folded inwardly by the hinges 34, as described in more detail below.

Each door 20, 22 is rotatably connected to the respective side panel 30, 32 by at least one, and preferably two, door hinges 58. In one aspect of the disclosure, for a ready-to-assemble cabinet 10, the doors 20, 22 are ready-to-assemble by quick-connect hinges 58. The frame 14 can be a pre-assembled with a first portion 60 of the door hinge 58 and the doors 20, 22 are pre-assembled with a second portion 62 of the door hinge 58 that is configured to be quickly coupled with the first portion 60 for quick and efficient attachment of the doors 20, 22 to the frame 14.

In addition to the components discussed thus far, the cabinet 10 can be shipped with shelf clips 64 that are coupled to the frame 14 and used to mount the shelf 26 to the frame 14 and feet 98 that are coupled to the frame 14 and used to support the cabinet 10 on a surface upon which the cabinet 10 stands, such as the ground, a floor, and the like. Additional fasteners or screws (not shown in FIG. 3) may be provided with the ready-to-assemble cabinet 10 for attachment of the top and bottom panels 16, 18 to the frame 14, and are described in further detail below.

Figure 4:
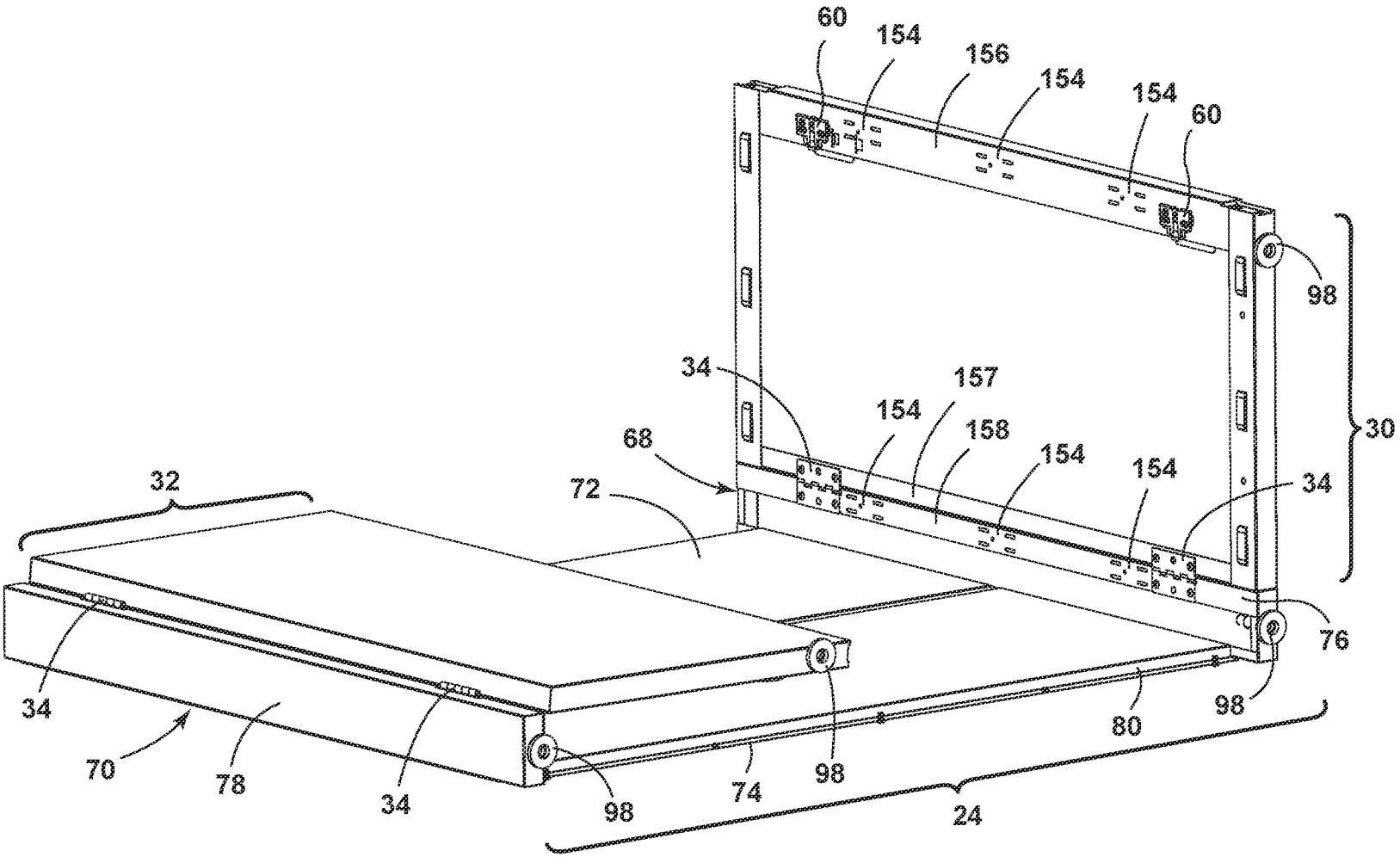
FIG. 4 is a bottom perspective view of a frame of the cabinet of FIG. 1, showing one side panel of the frame in an unfolded position and another side panel of the frame in a folded position.

FIG. 4 is a bottom perspective view of the frame 14, showing the first side panel 30 of the frame 14 in an unfolded position and the second side panel 32 of the frame 14 in a folded position with the side panel 32 folded inwardly about at least one hinge 34. In the embodiment illustrated, two hinges 34 rotatably connects the first side panel 30 to a first end 68 of the back panel 24 and two hinges 34 (visible in FIG. 3) rotatably connects the second side panel 32 to a second end 70 of the back panel 24.

In some embodiments, the back panel 24 can have an interior surface 72, an exterior surface 74, and end extension panels 76, 78 that project forwardly of the interior surface 72, where the side panels 30, 32 are coupled to the end extension panels 76, 78 by the hinges 34. For example, a first end extension panel 76 can be disposed at the first end 68 of the back panel 24, with the first side panel 30 rotatably connected to the first end 68 via the hinged attachment to the first end extension panel 76. A second end extension panel 78 can be disposed at the second end 70 of the back panel 24, with the second side panel 32 rotatably connected to the second end 70 via the hinged attachment to the second end extension panel 78.

In some embodiments, the back panel 24 can have a rear panel 80 defining one or both of the interior surface 72 and the exterior surface 74, and the end extension panels 76, 78 can be coupled with the rear panel, including by being formed with, fastened, welded, or otherwise attached to the rear panel 80. The end extension panels 76, 78 can extend perpendicularly to the rear panel 80. It noted that the rear panel 80 can itself comprise a single piece or multiple pieces that are fastened, welded, or otherwise attached together and/or to the extension panels 76, 78. The top and bottom panels 16, 18 can abut the rear panel 80 when coupled the frame 14. In the unfolded position of the frame 14, the side panels 30, 32 are rotated outwardly about hinges 34 and are oriented substantially orthogonally to the interior surface 72 and/or the rear panel 80. In the folded position of the frame 14, the side panels 30, 32 are rotated inwardly about hinges 34 and are oriented substantially parallel to the interior surface 72 and/or the rear panel 80. By "substantially" orthogonal or parallel, the panels 30, 32 may deviate up to 5 degrees, alternatively up to 10 degrees from orthogonal in the unfolded position and may deviate up to 5 degrees, alternatively up to 10 degrees from parallel in the folded position, alternatively up to 15 degrees from parallel in the folded position, alternatively up to 20 degrees from parallel in the folded position. In some embodiments, the side panels 30, 32 rotate about 90° about the hinges 34 between the folded and unfolded positions.

Figure 5:
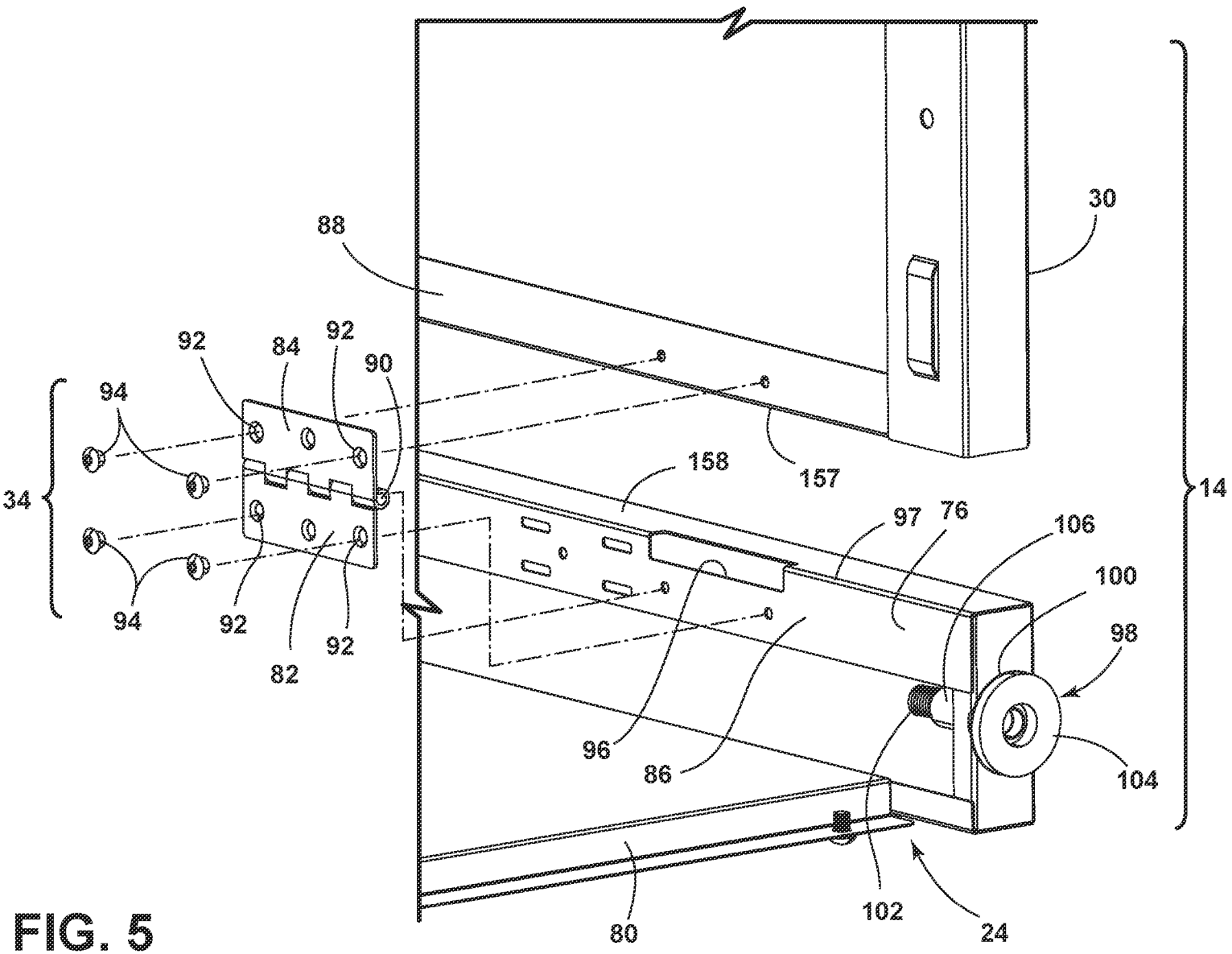
FIG. 5 is an enlarged, partially exploded view showing a hinged connection between the frame and one side panel.

FIG. 5 is an enlarged, partially exploded view showing a hinged connection between the frame 14 and the first side panel 30. In one embodiment, one or more of the panel hinges 34 are butt or mortise hinges that include a first leaf 82 for the back panel 24 and a second leaf 84 for the side panel 30, 32. In FIG. 5, one of the hinged connections for the first side panel 30 is shown, and it is understood that the other hinged connections may be substantially similar. The hinge leaves 82, 84 are connected to an interior surface 86 of the back panel 24 and an interior surface 88 of the side panel 30 so that the hinge 34 is not visible from the exterior of the storage cabinet 10 when the side panel 30 is unfolded. The leaves 82, 84 have several knuckles forming a barrel 90 and attached by a shaft or pin (not shown) running through the barrel 90. The leaves 82, 84 can have one or more holes 92 that fasteners or rivets 94 can be driven into to connect the leaf 82, 84 with the panel's interior surface 86, 88.

So that the hinges 34 are fully hidden when the cabinet 10 is assembled, the barrel 90 faces toward and is recessed into one or both of the back panel 24 and the side panel 30. To accommodate the barrel 90, one or both of the back panel 24 and the side panel 30 can have a barrel slot 96 sized to receive the barrel 90. The barrel slot 96 can be formed in the interior surface 86, 88 of one or both of the back panel 24 and the side panel 30, and does not penetrate an exterior surface thereof, so that the barrel slot 96, and therefore the barrel 90, is not visible form the exterior of the cabinet 10 when the side panel 30 is unfolded. The unfolded position of the first side panel 30 is shown in FIGS. 1-3 where the hinge 34 is not visible from the exterior of the frame 14, and the folded position of the second side panel 32 is shown in FIG.

4, where a portion of the hinge 34 is visible. In the embodiment shown, the barrel slot 96 is formed an interior edge 97 of the first end extension panel 76.

In one embodiment, the frame 14 can have an at least partially hollow construction that includes a plurality of vertically-extending hollow channels 157, 158. The panel interior surface 86, 88 on which the hinge leaves 82, 84 are mounted can be an interior-facing side of the channels 157, 158. In the embodiment shown, channels 157 are included at the rearward end of each side panel 30, 32 and channels 158 are included in each end extension panel 76, 78 adjacent the panel channels 157. Thus, the hinge 34 supported by the two channels 157, 158. With the hinge leaves 82, 84 being on interior sides of hollow channels 157, 158 of the frame 14 the leaves 82, 84 are not visible from the exterior of the cabinet 10. In the embodiment shown, the interior edge 97 in which the barrel slot 96 is formed is an interior edge forming the channel 158.

The frame 14 can further include other components. For example, and with reference to FIG. 4-5, the frame 14 can include four adjustable feet 98, each adjustable foot 98 including a base 100 and a stem 102 extending from the base 100, the base 100 including an outer contact surface 104, wherein each stem 102 is a threaded rod, and a bottom of the frame 14 includes a threaded aperture 106 cooperable with each threaded rod. The outer contact surface 104 rests on a surface upon which the storage cabinet 10 stands, such as the ground, a floor, and the like. The cabinet 10 can be leveled and clearance between a supporting surface (e.g., a floor) and the storage cabinet 10 can be adjusted with the feet 98. The outer contact surface 104 can be nylon or other suitable material to protect and provide grip on the floor. The bottom perspective view of the frame 14 of FIG. 4 illustrates the four adjustable feet 98, with each of the first side panel 30, second side panel 32, first end extension panel 76, second end extension panel 78, comprising one of the feet 98. Alternatively, the rear feet 98 can be disposed on the rear panel 8 80 or elsewhere on the back panel 24.

In FIGS. 4-5, the feet 98 are shown mounted on the frame 14. In at least some embodiments of the cabinet 10, the feet 98 are not preassembled with the frame 14, and are attached by the user, for example be threading the stem 102 into the threaded aperture 106.

Figure 6:
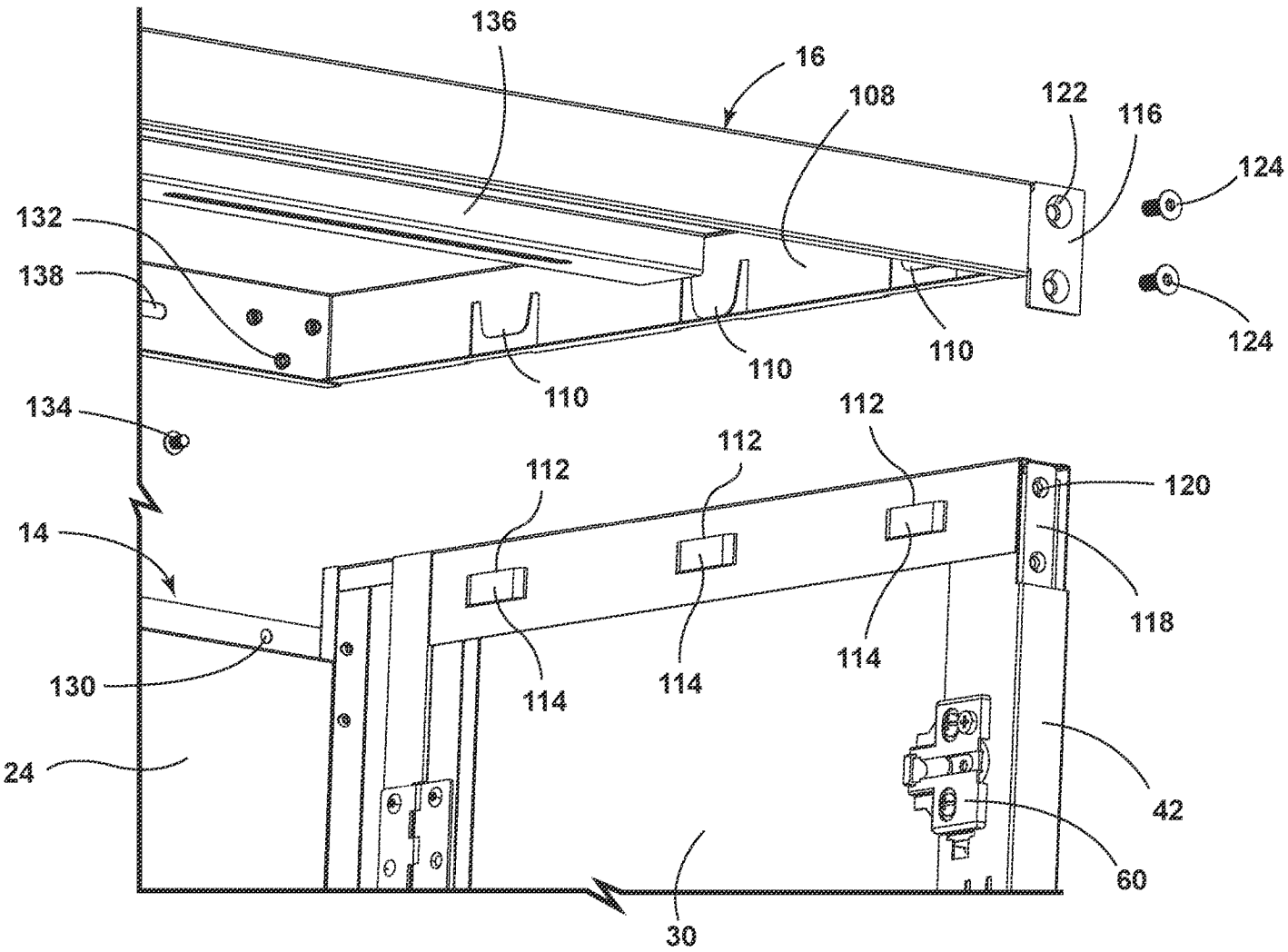
FIG. 6 is an enlarged bottom perspective view showing a top panel prior to assembly with the frame.
Figure 7:
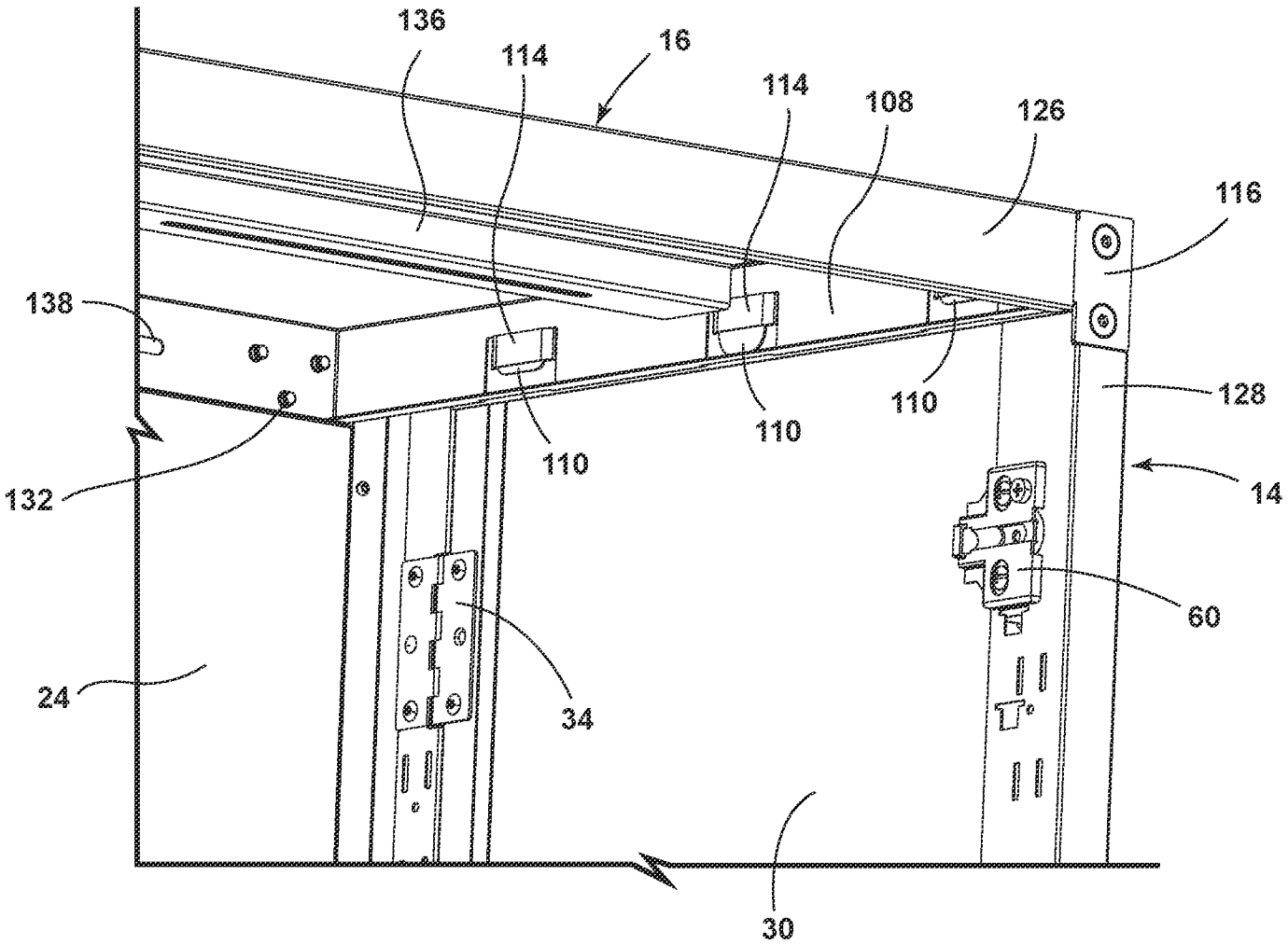
FIG. 7 is a view similar to FIG. 6 showing the top panel assembled with the frame.

FIGS. 6-7 are enlarged bottom perspective views showing attachment of the top panel 16 to the frame 14. The top panel 16 can be locked to each side panel 30, 32 of the frame 14 using a tab-and-slot interface, an example of which is shown in FIGS. 6-7. In FIG. 6-7, the interface between the first side panel 30 and the top panel 16 is shown, and it is understood that the interface between the second side panel 32 and top panel 16 may be substantially similar.

The top panel 16 can have one or more downwardly-extending side walls 108 having a plurality of downwardly-extending tabs 110 and the upper end 38 of the frame 14, such as the side panels 30, 32, can have a plurality of apertures 112 aligned with, and corresponding to, the tabs 110. Each tab 110 is adapted to be received in a corresponding aperture 112, when the top panel 16 is assembled, as illustrated in FIG. 7. For example, as the downwardly-extending side wall 108 is moved into the upper end 38 of the frame 14 the tabs 110 slide into a corresponding aperture 112. The apertures 112 may be formed as by closed loops 114 to limit forward-and-backward and left-to-right movement of the top panel 16 relative to the back panel 24 and side panels 30, 32. The loops 114 can extend in a horizonal to front-to-back direction, and the apertures 112 defined by the loops can open in a vertical or top-to-bottom direction. The top panel 16 can have two opposing side walls 108 forming the lateral sides of the top panel 16, such that the panel 16 is secured on both lateral sides thereof by sets of tabs 110 and corresponding apertures 112.

The top panel 16 can further be secured to the frame 14 with one or more additional fasteners. For example, at least one fastener can secure the top panel 16 to the side panels 30, 32 and/or at least one fastener can secure the top panel 16 to the back panel 24.

In one embodiment of an attachment with the side panels 30, 32, the top panel 16 can be connected to the front end 42 of the frame 14 by a bracket 116. The front end 42 can present a mounting surface 118 having one or more holes 120 and the bracket 116 has one or more holes 122 that are aligned therewith when the top panel 16 is slid into place. One or more fasteners or screws 124 can be driven into the aligned holes 120, 122 to connect the top panel 16 with the front end 42 of the frame 14. In one aspect, the bracket 116 can extend laterally outwardly relative to the downwardly-extending sides 108 and can be flush with a front surface 126 of the top panel 16. The mounting surface 118 can be recessed in a front edge 128 of the side panel 30 a distance corresponding to the thickness of the bracket 116 so that the bracket 116 is substantially flush with the front edge 128 of the side panel 30 when assembled. In other embodiment of the cabinet 10, the top panel 16 does not have brackets 116 and is attached to the side panel using one or more fasteners driven through the side wall 108 and into the side panel 30.

In one embodiment of an attachment with the back panel 24, the back panel 24 can have one or more holes 130 and the back panel 24 has one or more holes 132 that are aligned therewith when the top panel 16 is slid into place. One or more fasteners or screws 134 can be driven into the aligned holes 130, 132 to connect the top panel 16 with the back panel 24.

Referring to FIG. 7, the top panel 16 can further include other components. For example, the top panel 16 can have a horizontal brace 136 on an underside thereof to impart rigidity to the panel 16 and/or one or more ventilation slots 138 to ventilate the storage chamber 12.

The bottom panel 18 can be attached to the frame 14 in a similar manner as the top panel 16. For example, and referring to FIG. 3, the bottom panel 18 can have downwardly-extending side walls 140 having a plurality of upwardly-extending tabs 142 and the bottom end 40 of the frame 14, such as the side panels 30, 32, can have a plurality of apertures 144 aligned with, and corresponding to, the tabs 142. Each tab 142 is adapted to be received in a corresponding aperture 144, may be formed as by closed loops, when the bottom panel 16 is assembled with the frame 14. Additionally, the bottom panel 18 can have brackets 146 on the front surface 147 thereof, substantially similar to brackets 116, to secure the bottom panel 18 to the side panels 30, 32 using fasteners or screws 148 at lower mounting surfaces 150 in the front edges 128 of the side panels 30, 32. In other embodiment of the cabinet 10, the bottom panel 18 does not have brackets 146 and is attached to the side panels using one or more fasteners driven through the side wall 140 and into the side panel 30, 32.

The front surface 126 of the top panel 16 can be flush with the front edges 128 of the side panels 30, 32 when assembled. Similarly, the front surface 147 of the bottom panel 18 can be flush with the front edges 128 of the side panels 30, 32 when assembled This presents a flush front on the cabinet body once the top and bottom panels 16, 18 are attached to the frame 14.

Figure 8:
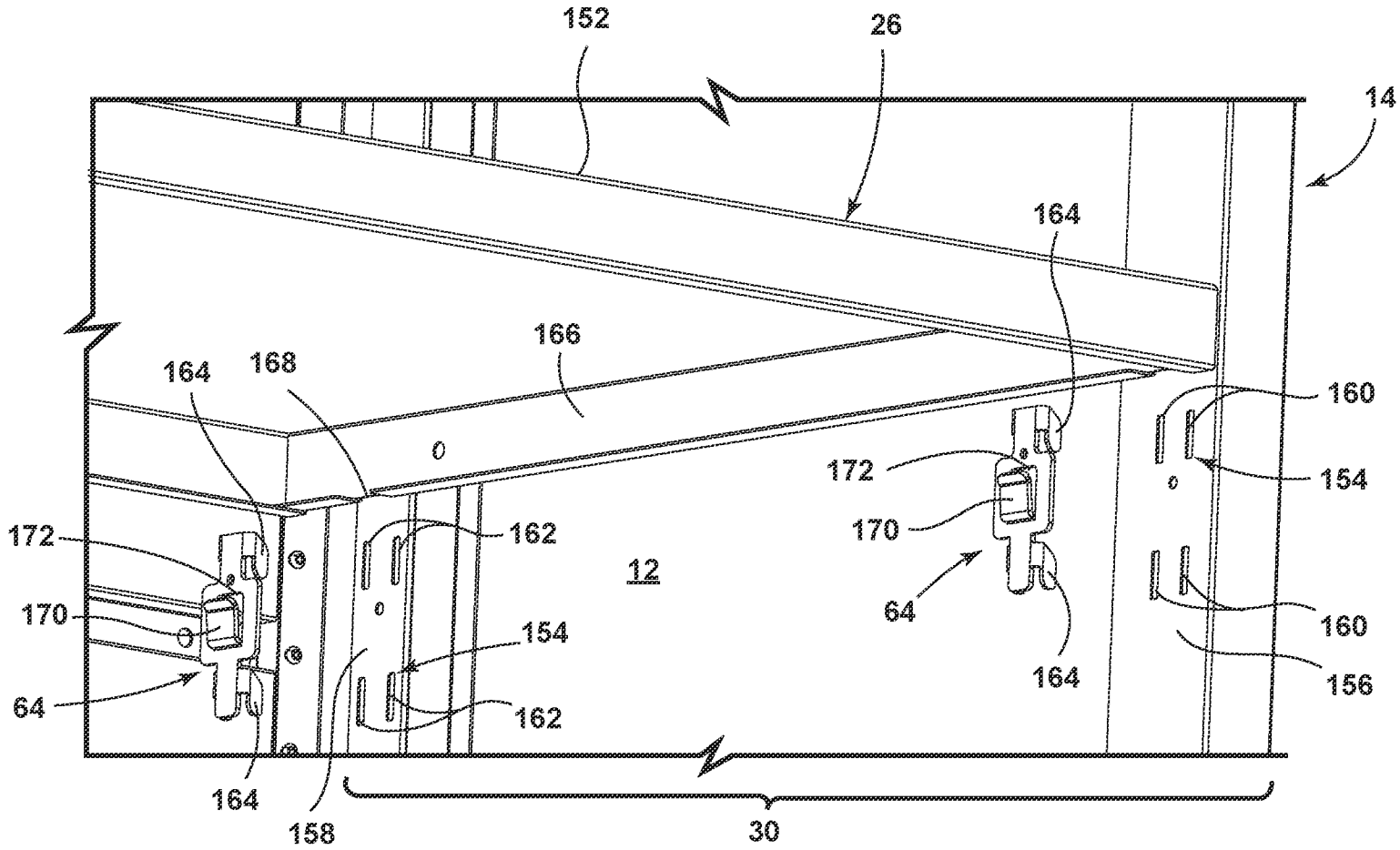
FIG. 8 is an enlarged bottom perspective views showing attachment of a shelf prior to assembly with the frame.
Figure 9:
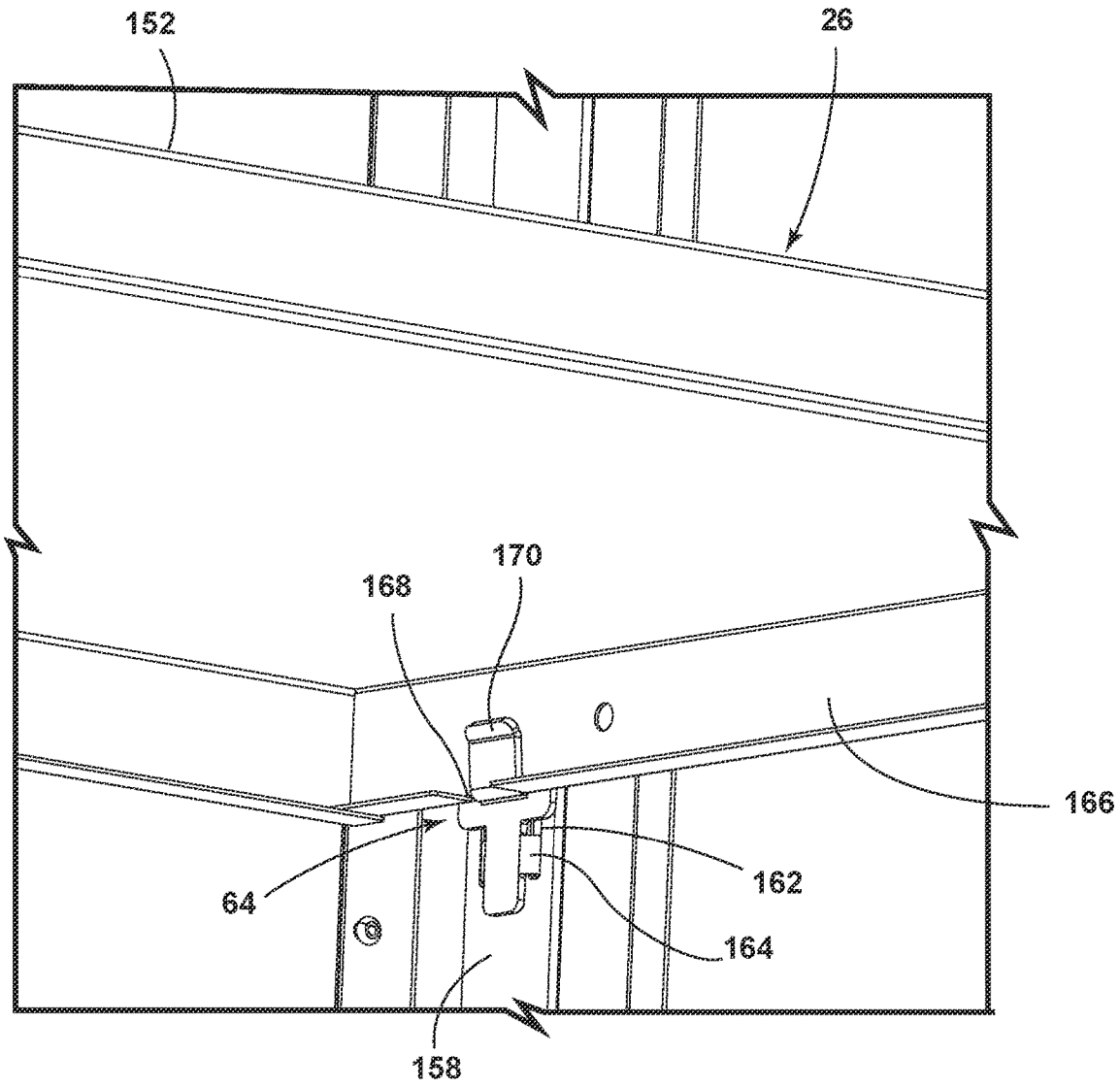
FIG. 9 is enlarged bottom perspective views showing the shelf assembled with the frame using a shelf clip.

FIGS. 8-9 are enlarged bottom perspective views showing attachment of the shelf 26 to the frame 14. The shelf 26 can be mounted to the frame 14 within the storage chamber 12 and defines a horizontal supporting surface 152 within the storage chamber 12. The shelf 26 can include metal, wood, a polymeric material, a composite material or combinations thereof.

The cabinet 10 can provide an adjustable mounting for the shelf 26 to allow the consumer to set the height of the shelf 26 to a desired height. The shelf 26 can be mounted to frame 14 using removable shelf clips 64 and the frame 14 can have a plurality of discreet attachment points 154 for attachment of the shelf clips 64 at different locations or heights on the frame 14. In FIG. 4, a number of discreet attachment points 154 are illustrated on the frame 14, and may be on the side panels 30, 32 and/or on the end extension panels 76, 78. Installation of the clips 64 can produce a "click" sound for audible feedback.

In one embodiment, the frame 14 can have an at least partially hollow construction that includes a plurality of vertically-extending hollow channels 156, 158. For receiving the shelf clips 64, a plurality of spaced-apart slots 160, 162 are formed in an interior-facing side of the channels 156, 158. In the embodiment shown, first or forward channels 156 are included in each side panel 30, 32 and second or rearward channels 158 are included in each end extension panel 76, 78. Thus, the shelf 26 can be supported by four shelf clips 64, with each clip 64 received in the slots 160, 162 of one of the four channels 156, 158. In FIG. 8, the rear clip 64 is shown in its mounted location in the rearward channel 158, and the shelf 26 and front clip 64 are exploded. In FIG. 9, the shelf 26 is shown mounted on the rear clip 64 in the rearward channel 158.

The shelf clips 64 include a plurality, and in this embodiment four, rearwardly extending downturned or hooked projections 164 which are sized and shaped as illustrated to allow the shelf clips 64 to be supported in the slots 160, 162. With the slots 160, 162 being on interior sides of hollow channels 156, 158 of the frame 14, the slots 160, 162 and shelf clips 64 are not visible from the exterior of the cabinet 10.

The shelf 26 can have depending side walls 166 having a lower edge 168. Each shelf clip 64 can have a tab 170 defining a slot 172, the tab 170 and slot 172 on an opposing side of the clip 64 as the hooked projections 164. The tab 170 is sized and shaped as illustrated to allow the shelf 26 to be supported in by the clip 64 with the lower edge 168 received in the slot 172.

Figure 11:
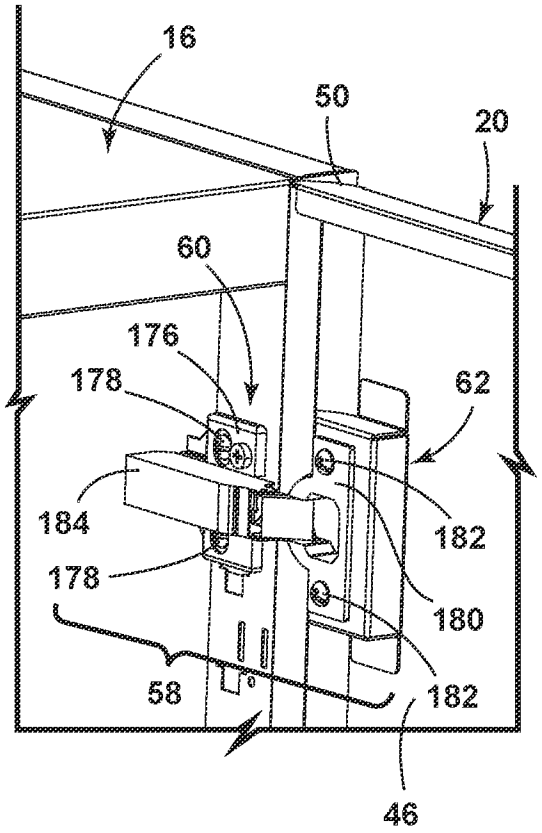
FIG. 11 is a view similar to FIG. 10 showing the door assembled with the frame.
Figure 10:
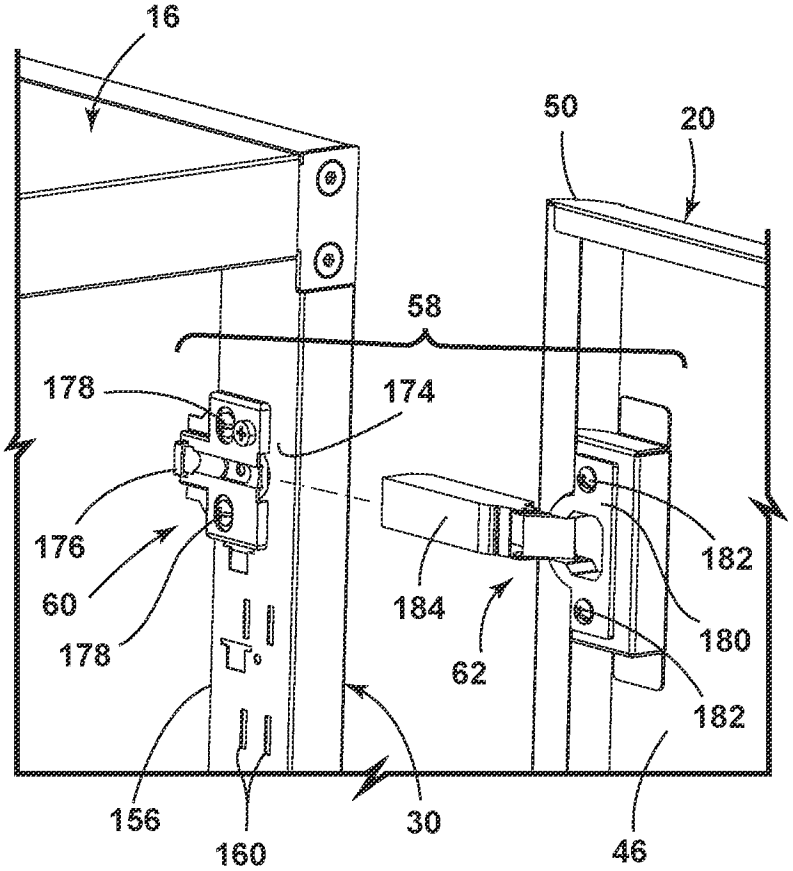
FIG. 10 is an enlarged perspective view showing one of the doors prior to assembly with the frame.

FIGS. 10-11 are enlarged perspective views showing attachment of the door 20 to the frame 14 by connecting the first portion 60 of the door hinge 58 with the second portion 62 of the door hinge 58. In FIG. 10-11, the attachment of the upper door hinge 58 connecting the first door 20 to the first side panel 30 is shown, and it is understood that the other door hinge connections may be substantially similar.

The first hinge portion 60 is attached to an interior surface of the side panel 30 and may be attached to an interior-facing side 174 of the hollow channel 156 of the side panel 30. The second hinge portion 62 is attached to the interior surface 46 of the door 20 near the outer edge 50 of the door 20 such that can be coupled with the first hinge portion 60.

In one embodiment, one or more of the door hinges 58 are concealed hinges that provide one of a frameless full overlay and frameless half overlay, and that is hidden when the doors 20, 22 are closed. The first hinge portion 60 can comprise a mounting plate 176 that is attached to the side panel 30 with one or more fasteners or screws 178. The second hinge portion 62 can comprise a hinge component on the door 20 that is coupleable with the mounting plate 176. The hinge component can include a hinge cup 180 mounted to the door 20 with one or more fasteners or screws 182 and a hinge arm 184 coupled with the cup 180 and which can be extended past the outer edge 50 of the door 20 and connect to the mounting plate 176.

In one embodiment, one or more of the door hinges 58 are soft-close concealed hinges that reduce the noise the doors 20, 22 make when being shut. For a soft-close hinge 58, soft-close mechanism can be integrated into the hinge cup 180 and/or the arm 184 can comprise a concealed damper.

To install the door 20, the second hinge portion 62 is opened to full extension and the arm 184 is connected to the mounting plate 176. In embodiment, the arm 184 is pressed against the mounting plate 176 until it clicks into position. The height and tamper of the doors 20, 22 can be individually adjusted using the screws 178 on the mounting plate 176 so that the doors 20, 22 align properly when shut.

The doors 20, 22 can further include other optional components. For example, and with reference to FIG. 3, the doors 20, 22 can have a vertical brace 186 on the interior side thereof to impart rigidity to the door 20, 22 and/or magnets 188 on interior corners thereof to aid in keeping the doors 20, 22 closed.

Figure 12:
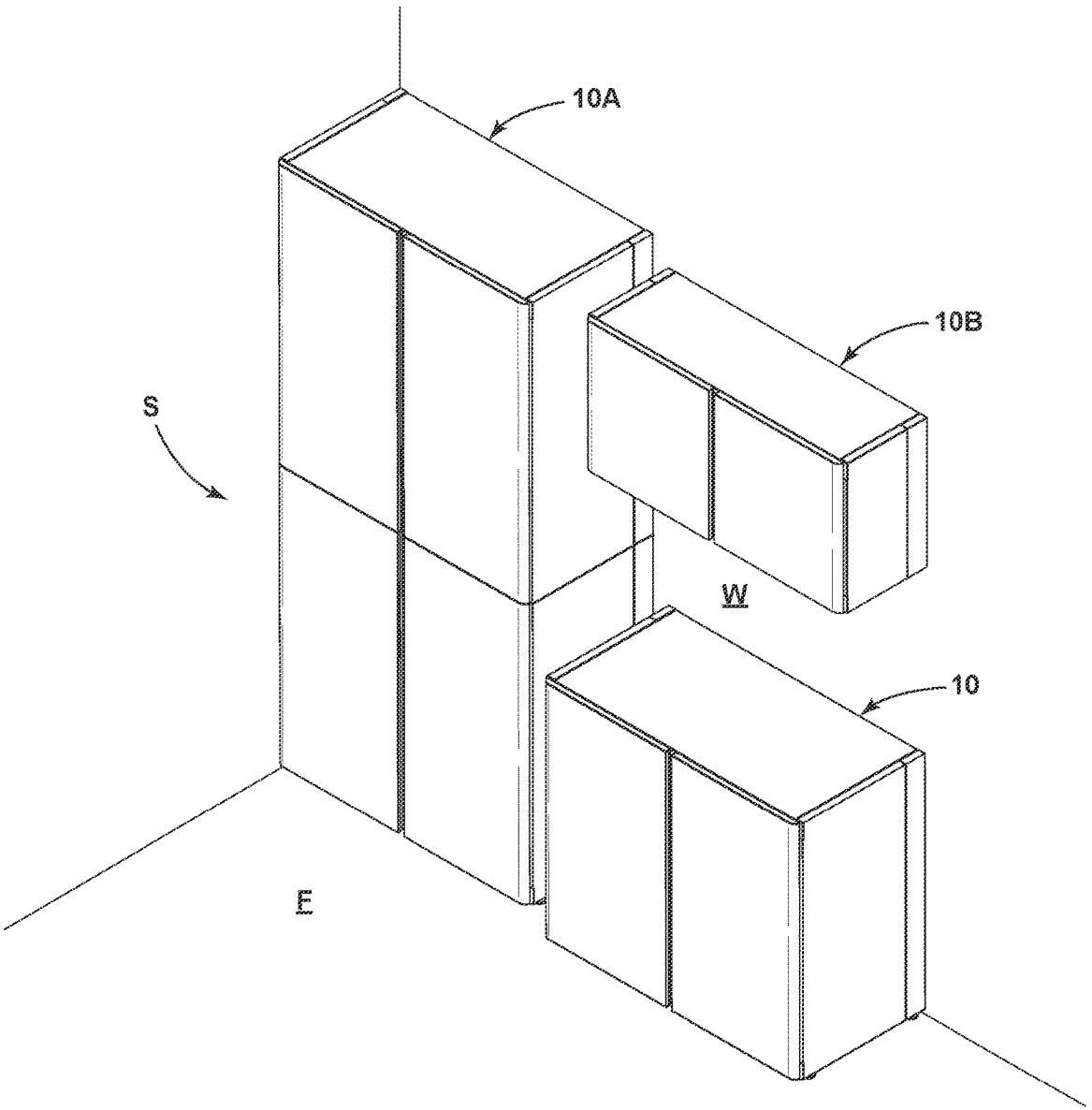
FIG. 12 is a perspective view of a storage system according to one aspect of the disclosure, the storage system including the storage cabinet of FIG. 1, a second cabinet; and a wall-mountable storage cabinet.

FIG. 12 illustrates of a storage system S according to one aspect of the disclosure, the storage system S including the storage cabinet 10 of FIGS. 1-11 and another storage cabinet 10A installed on a floor F of a home or other location and a wall-mountable storage cabinet 10B installed on a wall W of the home or other location. The arrangement and number of cabinets 10, 10A, 10B is for illustration purposes; other arrangements and numbers of cabinets are possible.

Figure 13:
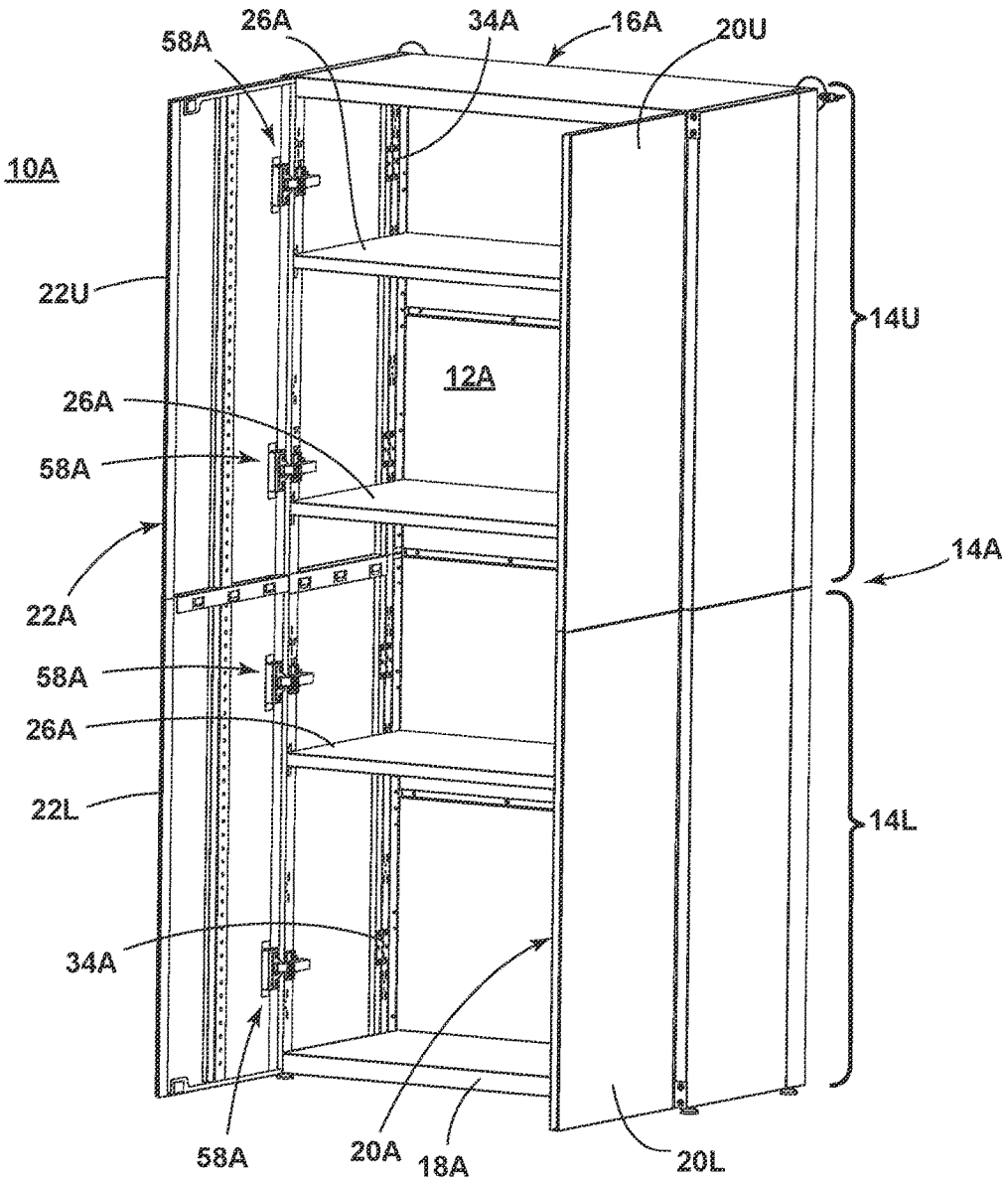
FIG. 13 is a perspective view of the second storage cabinet of FIG. 12 with doors of the cabinet in an open position, the storage cabinet including multiple upper and lower sub-assemblies.

FIG. 13 is a perspective view of the storage cabinet 10A from FIG. 12. The storage cabinet 10A may be similar in many respects to the storage cabinet 10 of FIGS. 1-11, and like elements are refereed to with the same reference numbers bearing the letter "A." One difference is that the cabinet 10A includes a frame 14A having upper and lower frame sub-assemblies 14U, 14L, a first door 20A having upper and lower door sub-assemblies 20U, 20L, and a second door having upper and lower door sub-assemblies 22U, 22L, and may further have multiple shelves 26A.

Each frame sub-assembly 14U, 14L can include the back panel 24A and hinged side panels 30A, 32A substantially as described above for frame 14 of cabinet 10. Storage cabinet 10A comprises two frame sub-assemblies 14U, 14L stacked vertically and coupled together to define the frame 14A.

Each door sub-assembly 20U, 20L, 22U, 22L be substantially similar to the doors 20, 22 described above for cabinet 10, and are stacked vertically and coupled together to define the first door 20A and second door 22B.

Figure 14:
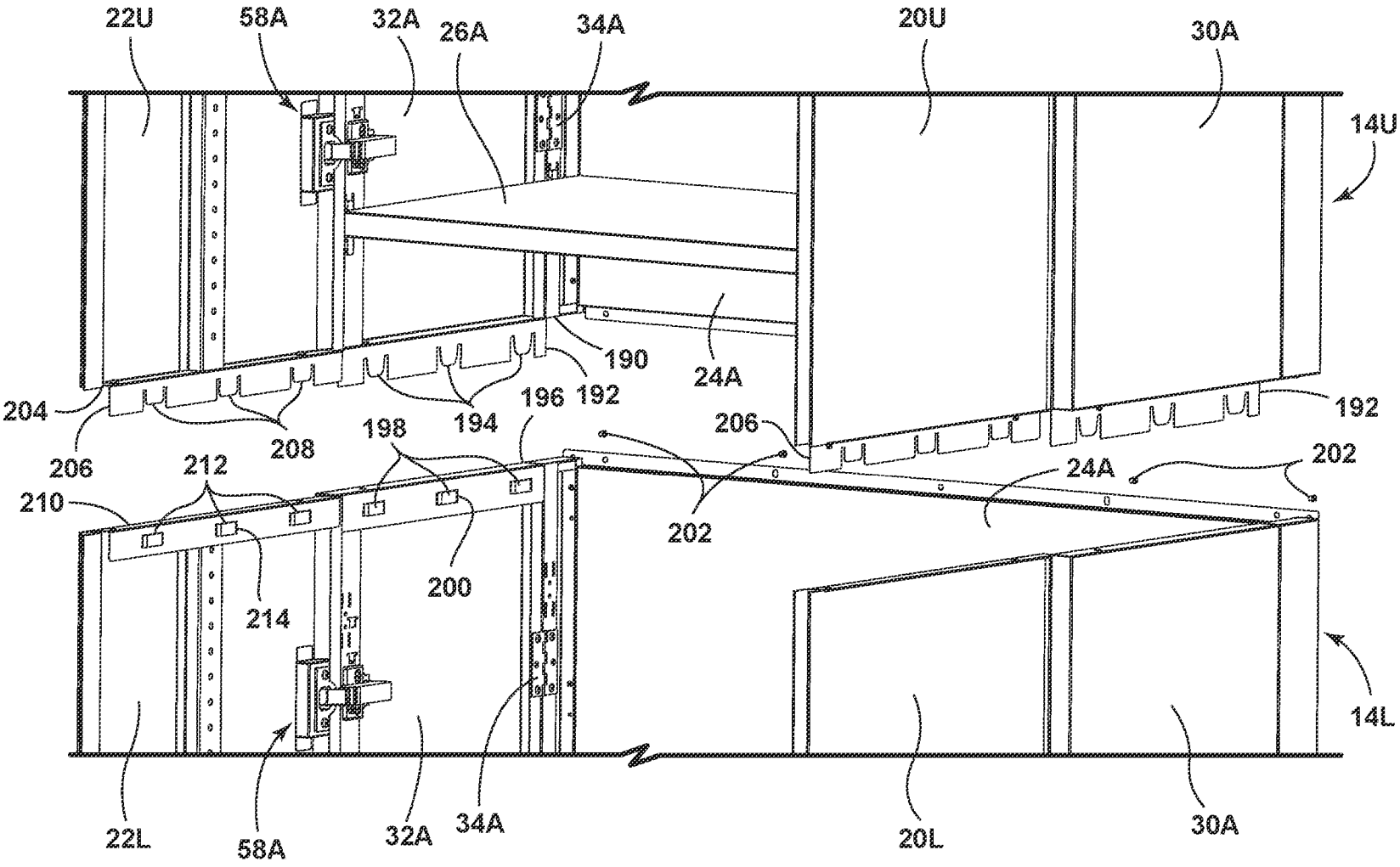
FIG. 14 is enlarged perspective view showing attachment of the upper and lower sub-assemblies.

FIG. 14 is an enlarged perspective view showing attachment of the upper and lower sub-assemblies, where the sub-assemblies are locked together using tab-and-slot interfaces.

For the frame 14A, a lower end 190 of the upper frame sub-assembly 14U can have downwardly-extending side flanges 192 having a plurality of downwardly-extending tabs 194 in each flange 192 and an upper end 196 of the lower frame sub-assembly 14L, can have a plurality of apertures 198 aligned with, and corresponding to, the tabs 194. Each tab 194 is adapted to be received in a corresponding aperture 198, when the frame 14A is assembled, as illustrated in FIG. 13. For example, as the flanges 192 are slid into the upper end 196 of the lower frame sub-assembly 14L, the tabs 194 slide into a corresponding aperture 198. The apertures 198 may be formed as by closed loops 200 to limit forward-and-backward and left-to-right movement of the frame sub-assemblies 14U, 14L relative to each other. The side panels 30A, 32B of the upper frame sub-assembly 14U can comprise the tabs 194 and the side panels 30A, 32B of the lower frame sub-assembly 14L can comprise the apertures 198, such that the frame connection is made with the side panels 30A, 32A unfolded as shown in FIG. 14. The loops 200 can extend in a horizonal to front-to-back direction, and the apertures 198 defined by the loops 200 can open in a vertical or top-to-bottom direction.

The frame sub-assemblies 14U, 14L can be secured with one or more additional fasteners. For example, at least one fastener 202 can secure the back panels 24A together.

For the doors 20A, 22A, the connection will be described with respect to second door 22A, with the understanding that the connection for the first door 20A can be substantially similar. A lower end 204 of the upper door sub-assembly 22U can have a depending flange 206 having a plurality of tabs 208 in the flange 206 and an upper end 210 of the lower door sub-assembly 22L, can have a plurality of apertures 212 aligned with, and corresponding to, the tabs 208. Each tab 208 is adapted to be received in a corresponding aperture 212, when the door 22A is assembled, as illustrated in FIG. 13. For example, as the flanges 206 are slid into the upper end 210 of the lower door sub-assembly 22L, the tabs 208 slide into a corresponding aperture 212. The apertures 212 may be formed as by closed loops 214 to limit forward-and-backward and left-to-right movement of the door sub-assemblies 22U, 22L relative to each other. The loops 214 can extend in a horizonal to front-to-back direction, and the apertures 212 defined by the loops 214 can open in a vertical or top-to-bottom direction.

Figure 15:
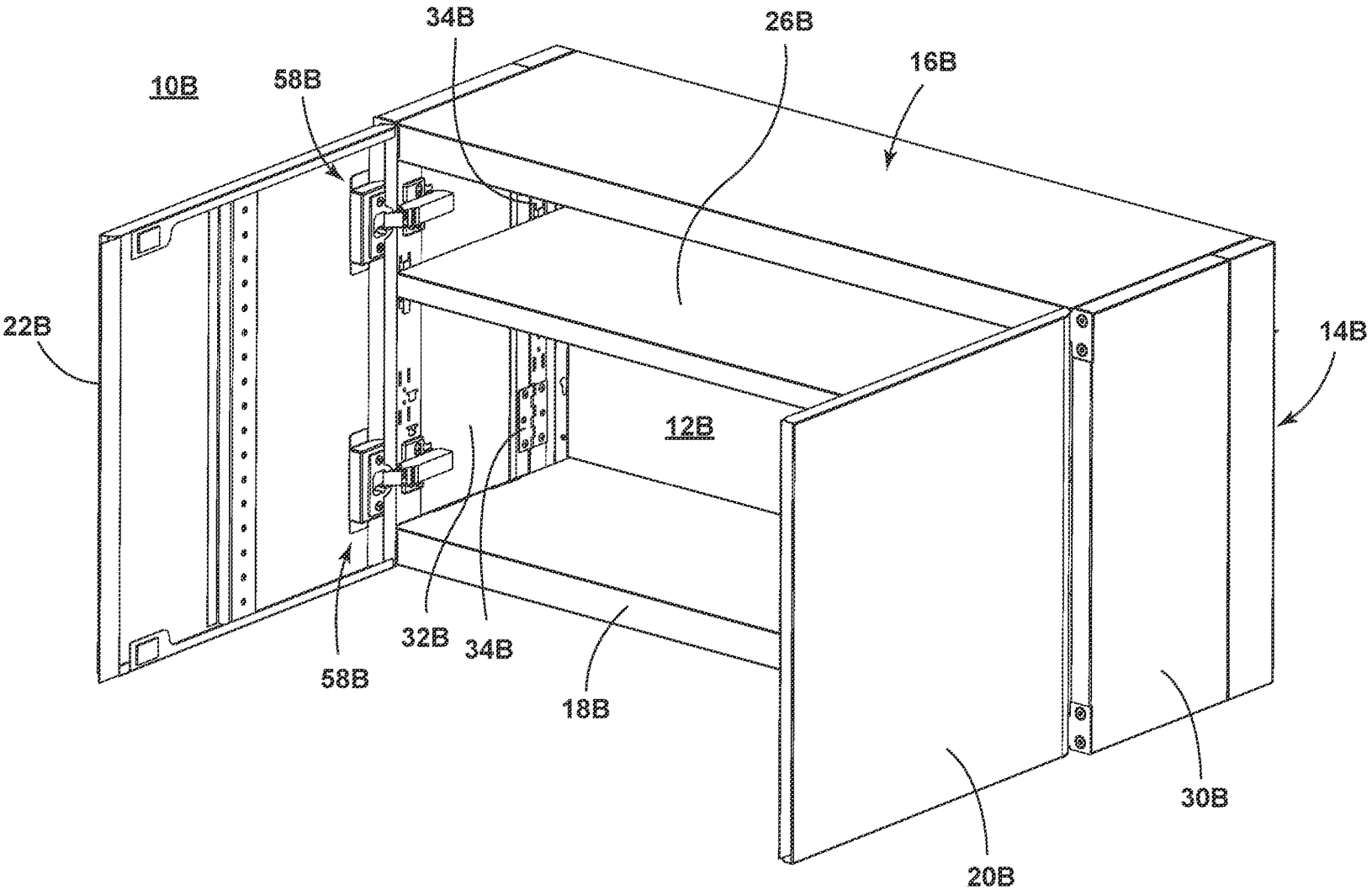
FIG. 15 is a perspective view of the wall-mountable storage cabinet of FIG. 12 with doors of the cabinet in an open position.

FIG. 15 is a perspective view of the storage cabinet 10B from FIG. 12. The storage cabinet 10B may be similar in many respects to the storage cabinet 10 of FIGS. 1-11, and like elements are refereed to with the same reference numbers bearing the letter "B." One difference is that the cabinet 10B is configured to be mounted on a wall of a building structure or other vertical supporting surface. The frame 14B does not comprise feet, and the back panel 24B can have a plurality of pre-formed holes (not shown) for attaching the frame 14B to a vertical supporting surface, such as to studs in a wall or to a block wall, using a plurality of fasteners (not shown).

While the cabinets 10, 10A, 10B are shown herein as comprising two doors, it is understood the other numbers of doors are possible, such as one door or more than two doors. As but one example, cabinet 10A can have four separately-opening doors instead of two doors.

The storage cabinet disclosed herein is load bearing and can support the weight of a person and or various objects. In some embodiments, the cabinet 10 has a load-bearing capacity of up to 200, 225, 250, 300, 350, 400, 450, or 500 lbs. In one embodiment, the cabinet 10 can have a load-bearing capacity of up to 300 lbs., with up to 100 lbs. supportable per shelf, and the cabinet 10A can have a load-bearing capacity of up to 500 lbs., with up to 100 lbs. supportable per shelf, and the wall cabinet 10B can have a load-bearing capacity of up to 225 lbs., with up to 75 lbs. supportable per shelf.

Any embodiment of the storage cabinet 10, 10A, 10B can be provided as a kit. The kit provides the components of the storage cabinet 10, 10A, 10B described above in preassembled in sub-assemblies designed to provide quick and efficient assembly of the storage cabinet of the storage cabinet 10, 10A, 10B. The kit can further include other components. For example, the kit can include fasteners, at least one safety strap for anti-tipping protection, a hex wrench or other tool, installation instructions, or any combination thereof.

A method of assembling a kit is also provided. The sequence of steps discussed is for illustrative purposes only and is not meant to limit the method in any way as it is understood that the steps may proceed in a different logical order, additional or intervening steps may be included, or described steps may be divided into multiple steps, without detracting from aspects described herein.

With reference to FIG. 3, the method of assembly may begin with the cabinet frame 14 laying on its back panel 24 with the side panels 30, 32 facing up and in the folded position. Next, each side panel 30, 32 is lifted upright to the unfolded position. Next, the top panel 16 and bottom panel 18 are locked to each side panel 30, 32 using the tab-and-slot interfaces. After turning cabinet body upright to rest on the bottom panel 18, the top and bottom panels 16, 18 are secured with secured with one or more additional fasteners if provided. To attach the shelf 26, the shelf clips 64 are installed on the frame 14 at a desired height, and the shelf 26 is slid into the frame 14 above the clips 64 and lowered into place onto the clips 64.

To attach the doors 20, 22, the doors 20, 22 are lined up with their respective second hinge portions 62 aligned with the first hinge portions 60 on the frame and coupled together. If needed, the height and tamper of each door 20, 22 can be individually adjusted.

If the cabinet comprises feet, 98 (e.g., cabinet 10, 10A), the feet 98 can be attached to the frame before or after attaching the top and bottom panels 16, 18, and preferably before turning the cabinet body upright.

With reference to FIGS. 14-13, if the cabinet comprises upper and lower sub-assemblies for the frame and doors (e.g., cabinet 10A), the top panel 16A can be locked to the upper frame sub-assembly 14U and the bottom panel 18A can be locked to the lower frame sub-assembly 14L, and then the two frame sub-assemblies 14U, 14L can be locked together using the tab-and-slot interfaces, preferably before turning the cabinet body upright. Next, the lower door sub-assemblies 20L, 22L can be attached to the lower frame sub-assembly 14L, and then the upper door sub-assemblies 20U, 22UL can be locked to lower door sub-assemblies 20L, 22L using the tab-and-slot interfaces, preferably before connecting the upper door hinges.

With reference to FIG. 15, if the cabinet is wall-mounted (e.g., cabinet 10B) the cabinet body can be mounted on a wall of a building structure or other vertical supporting surface before attaching the doors 20, 22, and optionally also before attaching any shelves 26.

Directional terms, such as "front," "back," "top," "bottom," "upper," "lower," "inner," "inwardly," "outer," "outwardly," "vertical," and "horizontal," are used to assist in describing the storage cabinet 10 and features thereof based on the orientation of the storage cabinet shown in the illustrations, e.g., where the storage cabinet 10 is resting on a floor of a building structure or other horizontal supporting surface or mounted on a wall of a building structure or other vertical supporting surface. The use of directional terms should not be interpreted to limit the invention to any specific orientations, unless otherwise noted.

The terms "coupled," "couple," and variable thereof are used herein in their broadest sense to mean and encompass the notions of being formed or integrated with, connected, mounted, attached, or otherwise joined.

The terms "comprising" or "comprise" are used herein in their broadest sense to mean and encompass the notions of "including," "include," "consist(ing) essentially of," and "consist(ing) of. The use of "for example," "e.g.," "such as," and "including" to list illustrative examples does not limit to only the listed examples. Thus, "for example" or "such as" means "for example, but not limited to" or "such as, but not limited to" and encompasses other similar or equivalent examples.

The above description relates to general and specific embodiments of the disclosure. However, variations can be made without departing from the spirit and broader aspects of the disclosure as defined in the claims which are to be interpreted in accordance with the principles of patent law including the doctrine of equivalents. This disclosure is presented for illustrative purposes and should not be interpreted as an exhaustive description of all embodiments of the disclosure or to limit the scope of the claims to the specific elements illustrated or described in connection with these embodiments. Any reference to elements in the singular, for example, using the articles "a," "an," "the," or "said," is not to be construed as limiting the element to the singular.

What is claimed is:

1. A kit for assembling a storage cabinet defining a storage chamber, the kit including:

a pre-assembled frame comprising:

a back panel having an interior surface, a first end and a second end;

a first side panel rotatably connected to the first end of the back panel by at least one first panel hinge, the first side panel comprising a first vertically-extending hollow channel and a first door hinge mounting plate attached to an interior-facing side of the first vertically-extending hollow channel;

a second side panel rotatably connected to the second end of the back panel by at least one second panel hinge, the second side panel comprising a second vertically-extending hollow channel and a second door hinge mounting plate attached to an interior-facing side of the second vertically-extending hollow channel;

a third vertically-extending hollow channel in the first end of the back panel;

a fourth vertically-extending hollow channel in the second end of the back panel;

a fifth vertically-extending hollow channel in the first side panel; and a sixth vertically-extending hollow channel in the second side panel;

wherein the pre-assembled frame comprises a folded position in which the first and second side panels are oriented substantially parallel to the interior surface of the back panel and the interior-facing sides of the first and second vertically-extending hollow channels face the interior surface of the back panel, and an unfolded position in which the first and second side panels are oriented substantially orthogonally to the interior surface of the back panel;

a top wall connectable to an upper end of the pre-assembled frame in the unfolded position;

a bottom wall connectable to a bottom end of the pre-assembled frame in the unfolded position;

a first door rotatably connectable to the first side panel by at least one first door hinge comprising a hinge component on an interior surface of the first door that is couplable with the first door hinge mounting plate; and a second door rotatably connectable to the second side panel by at least one second door hinge comprising a hinge component on an interior surface of the second door coupled with the second door hinge mounting plate;

wherein the first panel hinge comprises a portion mounted on an interior-facing side of the fifth vertically-extending hollow channel and a portion mounted on an interior-facing side of the third vertically-extending hollow channel to rotatably connect the first side panel and the first end of the back panel; and wherein the second panel hinge comprises a portion mounted on an interior-facing side of the sixth vertically-extending hollow channel and a portion mounted on an interior-facing side of the fourth vertically-extending hollow channel to rotatably connect the second side panel and the second end of the back panel.

2. The kit of claim 1, wherein the back panel comprises:

a first end extension panel that projects forwardly of the interior surface of the back panel;

a second end extension panel that projects forwardly of the interior surface of the back panel; and a rear panel defining the interior surface of the back panel, wherein the first and second end extension panels are coupled to the rear panel and the first and second end extension panels extend perpendicularly to the rear panel;

wherein the first side panel is rotatably connected to the first end extension panel by the at least one first panel hinge and the second side panel rotatably connected to the second end extension panel by the at least one second panel hinge.

3. The kit of claim 1, wherein the back panel comprises a first end extension panel that projects forwardly of the interior surface of the back panel, and a second end extension panel that projects forwardly of the interior surface of the back panel, wherein the first side panel is rotatably connected to the first end extension panel by the at least one first panel hinge and the second side panel rotatably connected to the second end extension panel by the at least one second panel hinge.

4. The kit of claim 3, wherein the back panel comprises a rear panel defining the interior surface of the back panel, and the first and second end extension panels are coupled to the rear panel and the first and second end extension panels extend perpendicularly to the rear panel.

5. The kit of claim 4, wherein the at least one first panel hinge comprises a mortise hinge comprising a first leaf coupled to an interior surface of the first end extension panel and a second leaf coupled to an interior surface of the first side panel, wherein the first leaf and the second leaf form a barrel that is received within a barrel slot formed in the first end extension panel.

6. The kit of claim 1, wherein the pre-assembled frame comprises a plurality of adjustable feet, each adjustable foot including a base and a stem extending from the base, the base including an outer contact surface, wherein each stem is a threaded rod, and the pre-assembled frame comprises a threaded aperture cooperable with each threaded rod.

7. The kit of claim 1, wherein the top wall comprises a pair of spaced, downwardly-extending lateral side walls, each downwardly-extending lateral side wall having a plurality of downwardly-extending tabs, and wherein the first and second side panels comprise a corresponding plurality of apertures aligned with and receiving the plurality of downwardly-extending tabs, with each one of the plurality of downwardly-extending tabs received in one of the corresponding plurality of apertures.

8. The kit of claim 7, wherein the plurality of apertures are formed by closed loops on an interior surface of the top wall, wherein the loops extend in a front-to-back direction such that the apertures formed by the loops open in a top-to-bottom direction.

9. The kit of claim 8, wherein the top wall comprises a front surface that is flush with a front edge of the first side panel and a front edge of the second side panel and the bottom wall comprises a front surface that is flush with the front edge of the first side panel and the front edge of the second side panel.

10. The kit of claim 1, wherein the pre-assembled frame comprises a plurality of slots formed in interior-facing sides of the first, second, third, and fourth vertically-extending hollow channels, the plurality of slots configured to receive one or more shelf clips to support a shelf within the storage chamber.

11. The kit of claim 1, wherein the pre-assembled frame comprises:

wherein the first panel hinge comprises a first leaf mounted on the interior-facing side of the first vertically-extending hollow channel and a second leaf mounted on an interior-facing side of the third vertically-extending hollow channel to rotatably connect the first side panel and the first end of the back panel; and wherein the first leaf and the second leaf form a barrel that is received within a barrel slot formed in an interior edge of the third vertically-extending hollow channel.

12. The kit of claim 1, wherein the first and second door hinges are at least one of concealed door hinges and soft close door hinges.

13. The kit of claim 1, wherein the hinge component on the interior surface of the first door comprises a hinge cup mounted to the interior surface of the first door and a hinge arm coupled with the hinge cup.

14. The kit of claim 1, comprising:

a third door rotatably connected to the first side panel; and a fourth door rotatably connected to the second side panel.

15. The kit of claim 1, comprising a third door rotatably connected to the pre-assembled frame and a fourth door rotatably connected to the pre-assembled frame.

16. The kit of claim 1, wherein the pre-assembled frame comprises:

an upper frame sub-assembly comprising the back panel, first side panel, and second side panel, wherein the back panel is an upper back panel;

a lower frame sub-assembly comprising:

a lower back panel having a first end and a second end;

a third side panel rotatably connected to the first end of the lower back panel by at least one third panel hinge, the third side panel comprising a mounting plate on an interior surface of the third side panel; and a fourth side panel rotatably connected to the second end of the lower back panel by at least one fourth panel hinge, the fourth side panel comprising a mounting plate on an interior surface of the fourth side panel;

a third door rotatably connected to the third side panel by at least one third door hinge comprising a hinge component on an interior surface of the third door coupled with the mounting plate on the interior surface of the third side panel; and a fourth door rotatably connected to the fourth side panel by at least one fourth door hinge comprising a hinge component on an interior surface of the fourth door coupled with the mounting plate on the interior surface of the fourth side panel;

wherein the top wall is connected to an upper end of the upper frame sub-assembly; and wherein the bottom wall is connected to a bottom end of the lower frame sub-assembly.

* * * * *